United States Patent [19]

Shubb et al.

[11] 4,250,790

[45] Feb. 17, 1981

[54] CAPO

[76] Inventors: Richard Shubb, P.O. Box 5311, Berkeley, Calif. 94705; David Coontz, P.O. Box 283, Corydon, Iowa 50060

[21] Appl. No.: 86,852

[22] Filed: Oct. 22, 1979

[51] Int. Cl.[3] ..... G10D 3/04

[52] U.S. Cl. ..... 84/318

[58] Field of Search ..... 84/318

[56] References Cited

U.S. PATENT DOCUMENTS

| | | | |
|---|---|---|---|
| 390,612 | 10/1888 | Moffat | 84/318 |
| 468,193 | 2/1892 | Dahlman et al. | 84/318 |
| 4,104,947 | 8/1978 | Oster | 84/318 |
| 4,149,443 | 4/1979 | Bringe | 84/318 |

*Primary Examiner*—Lawrence R. Franklin
*Attorney, Agent, or Firm*—Thomas E. Ciotti

[57] ABSTRACT

An adjustable, positive locking capo for use with stringed instruments such as banjos and guitars is disclosed. The capo comprises a frame (19) having a top arm (25) that bears against the strings when the capo is in operation and a side arm (26) that extends laterally of the instrument neck and carries a pivotally attached jaw member (22) that extends under the back of the instrument neck and engages same when the capo is in operation, and a pivotally attached lever member (23) located below the jaw member. An adjusting screw (24) extends through the lever member and bears against the underside of the jaw member when the lever member is pivoted toward the jaw member thereby closing the jaw member on the back of the neck and forcing the fingerboard against the top arm whereby the strings are depressed. The adjusting screw may be advanced or backed off to vary the extent to which the jaw member closes and thus, the pressure exerted on the strings. A zone of interference between the jaw member and adjusting screw effects a positive locking action of the capo on the neck as the lever member is pivoted to its upwardmost position.

8 Claims, 5 Drawing Figures

CAPO

FIELD OF INVENTION

The invention relates to a capo for a stringed musical instrument having a neck and fingerboard.

BACKGROUND ART

Capodastros, or capos as they are now commonly called, are devices that are placed about the necks of stringed instruments such as guitars, banjos, ukuleles, and the like to depress the stings of the instrument and thereby shorten the effective vibrating length of the strings and alter their pitch.

U.S. Pat. Nos. 390,612, 468,193, and 4,149,443 disclose capos similar to the invention capo. These patented capos each include (1) a frame or body that has a top arm or presser bar that is designed to extend transversely over the strings and an integral side arm that extends from the presser bar laterally of the instrument neck; (2) a clamping jaw that is pivotally connected to the side arm; and (3) a lever mechanism pivotally attached to the side arm below the clamping jaw that engages the jaw and thereby causes the jaw to be closed against the back of the neck thus forcing the fingerboard up against the top arm to depress the strings that run longitudinally along the fingerboard. In U.S. Pat. No. 390,612 the lever mechanism is a cam lever that when pivoted bears against the bottom of the clamping jaw. In U.S. Pat. No. 468,193 the lever mechanism is a lever-V-spring assembly wherein one end of the spring is attached to the lever and the other is attached to the jaw. When the lever is pivoted the spring is compressed and the jaw is forced against the back of the neck. U.S. Pat. No. 4,149,443 discloses a variation of the capo of U.S. Pat. No. 390,612 in which the bearing surface of the cam lever has dwell and rise surfaces. When the cam lever is pivoted the jaw is cammed incrementally toward the back of the instrument neck. The pressure exerted by these cam lever type capos depends upon the degree to which the cam lever is rotated. To obtain the same pressure each time the capo is applied to the neck, the cam must be rotated to exactly the same position. While the lever-V-spring type capo applies the same pressure each time it is applied, the capo is not readily adjustable for use on other instruments.

The principal object of the invention capo is to provide a capo that is adjustable, is fast and easy to use, exerts the same pressure each time it is used, has a positive locking action when applied to the instrument neck, and may be released instantly.

DISCLOSURE OF INVENTION

The invention is a capo for use with stringed instruments, such as banjos, guitars, and the like, that have a neck having a fingerboard and a back and a plurality of strings that extent longitudinally over the fingerboard. The capo comprises a frame or body that includes a top arm that extends across the fingerboard above the strings and a side arm that extends generally laterally of the instrument neck; a jaw member that extends under the back of the neck and is pivotally attached at one of its ends to the side arm; a lever member pivotally attached at one of its ends to the side arm below the jaw member; and an adjusting screw having a threaded shaft that is received through a threaded bore in the lever member with one end of the shaft bearing against the underside of the jaw member when the capo is in operation.

BRIEF DESCRIPTION OF THE DRAWINGS

In the drawings:

In FIG. 5 the links are numbered to correspond with the members of FIGS. 1–4 that they represent.

DESCRIPTION OF EMBODIMENT SHOWN IN DRAWINGS

Figure 1:
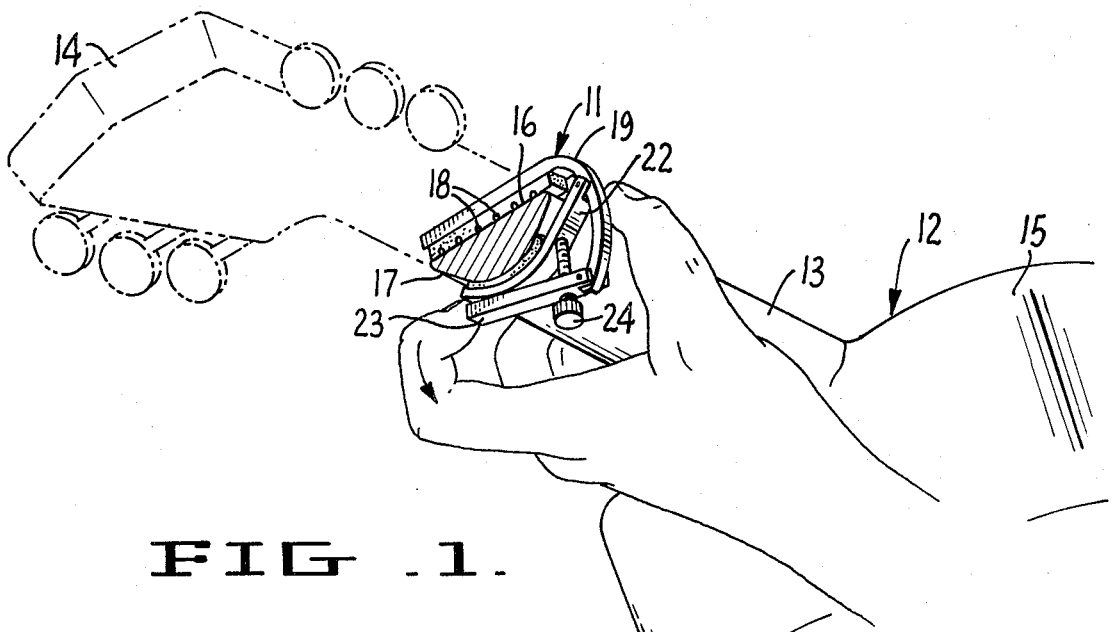
FIG. 1 is a partly sectional, perspective view of the capo attached to the neck of a guitar.

FIG. 1 shows the invention capo, generally designated 11, in use on a guitar, generally designated 12. Capo 11 is positioned on neck 13 of the guitar between the head 14 and sound body 15 of the guitar. Neck 13 includes flat fingerboard 16 and a curved back 17. Six guitar strings 18 run longitudinally over neck 13 from head 14 to sound body 15.

Figure 2:
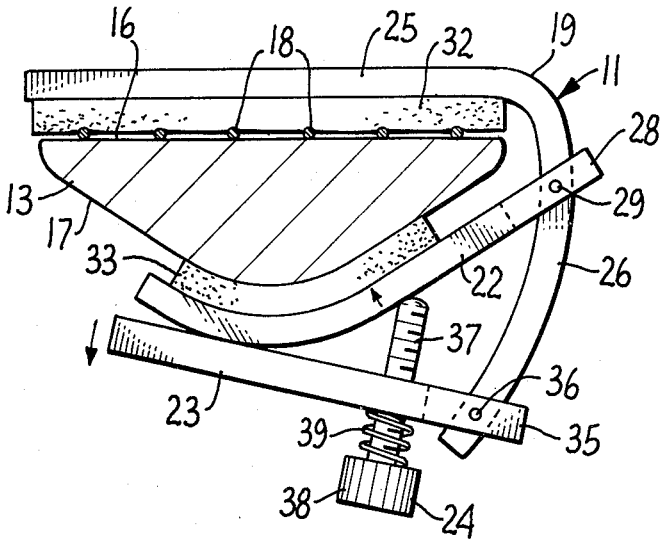
FIG. 2 is a side elevational view of the capo of FIG. 1 depicting the capo in its clamped position on the guitar neck.
Figure 3:
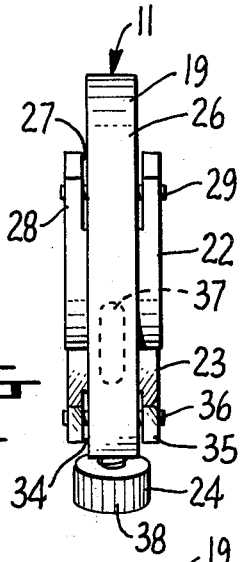
FIG. 3 is an end view of the capo of FIG. 1 in the position shown in FIG. 2.
Figure 4:
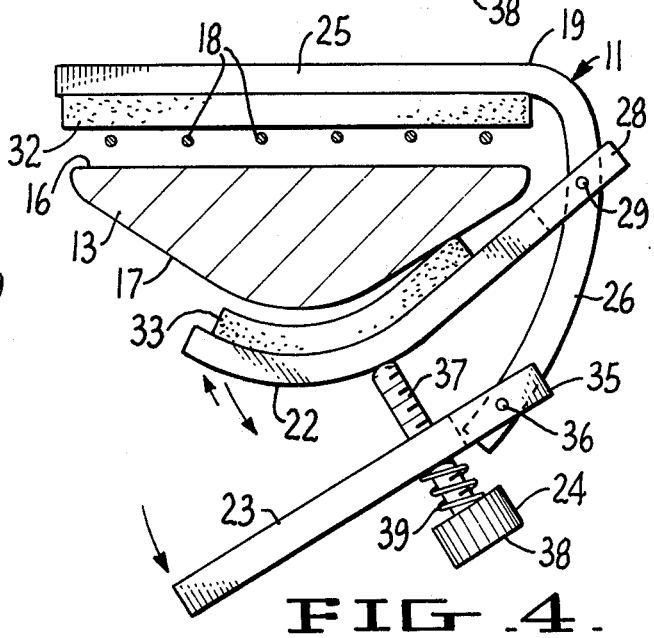
FIG. 4 is a side elevational view of the capo of FIG. 1 showing the capo in its released or unclamped position.

Referring to FIGS. 2–4, the main elements of capo 11 are a frame 19, a clamping jaw 22, a lever 23, and an adjusting screw 24. Frame 19 consists of a top arm 25 that extends across strings 18 and a curved side arm 26 that extends generally laterally of neck 13 and is integrally connected at one end to top arm 25. Clamping jaw 22 is pivotally connected to side arm 26 at a site between the free end of side arm 26 and the end connected to top arm 25. To make the connection between jaw 22 and side arm 26, jaw 22 has a slot 27 in its end 28 of sufficient width to receive side arm 26, and a roll pin 29 is inserted through bores in the lugs formed in end 28 by slot 27 and a bore through side arm 26. Clamping jaw 22 extends at a downward incline relative to the top arm 25 below the back of the guitar neck and is curved to generally fit the curve of the back of the guitar neck. Preferably the underside of top arm 25 carries a resilient pad 32 for engaging strings 18. Likewise the topside of clamping jaw 22 carries a resilient pad or cushion 33 for engaging the back of the guitar neck.

Lever 23 is pivotally connected to side arm 26 below the connection of jaw 22 and near the free end of side arm 26. This connection is made in the same manner as the connection between jaw 22 and side arm 26. That is, lever 23 has a slot 34 in its connected end 35 of sufficient width to receive side arm 26 and a roll pin 36 is inserted through bores in the lugs on end 35 formed by slot 34 and through a bore in side arm 26. Lever 23 is planar and in its locked position (FIG. 2) extends at an upward incline relative to top arm 25 below jaw 22. Lever 23 has a threaded bore (not shown) through it located between its mid-point and its connected end for receiving threaded shaft 37 of adjusting screw 24. Screw 24 has a knurled head 38 which may be gripped to turn screw 24 to withdraw or advance it. Screw 24 is also equipped with a cylindrical helical spring 39 that rests between the bottom side of lever 23 and head 38. Spring 39 maintains the set position of shaft 37 within the bore in the lever arm.

Capo 11 has several operational features that make it easy to use and reliable. It may be placed about the neck of a stringed instrument, such as guitar 12, removed, and replaced or repositioned quickly. In most instances, once screw 24 is adjusted for a particular instrument, capo 11 will provide the same compression to the strings of the instrument each time it is applied without need for readjustment of screw 24. Screw 24 requires readjustment only if (1) the taper of the instrument neck varies significantly and the capo position is changed significantly, (2) a different string compression is desired, or (3) capo 11 is used on a different instrument. The positive over-center closing action provided by capo 11 creates a compressive force that is substantially perpendicular to the fingerboard. The correlative absence of any significant force component parallel to the fingerboard eliminates any sideways distortion of the strings. Also, since the pressure adjustability of capo 11 is continuous rather than incremental, it is possible to exert precise pressure on the strings. The exertion of such pressure minimizes pitch distortion or tone muffling.

Figure 5:
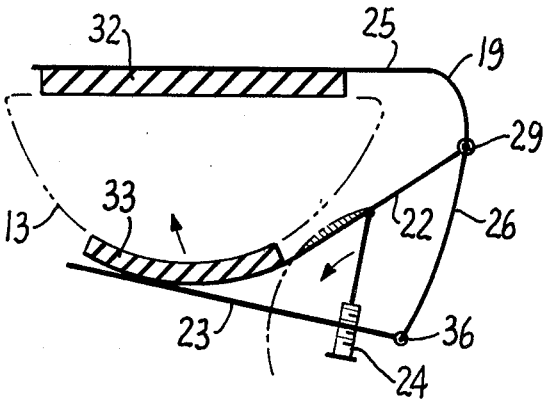
FIG. 5 is a link diagram of the capo of FIG. 1.

The manner in which capo 11 is used and manipulated is shown in the drawings. First, it is manipulated into its open position (FIG. 4) by pivoting lever 23 downwardly and away from top arm 25 (this motion is depicted by an arrow in FIG. 4). This pivoting enables jaw 22 to open (also depicted by an arrow in FIG. 4). Capo 11 is then slipped over neck 13 such that top bar 25 is sitting above and generally transversely of strings 18 and jaw 22 is positioned below the back 17 of neck 13. With capo 11 in this position it may be slid longitudinally along neck 13 to the point thereon at which it is desired to compress strings 18 against fingerboard 16. Once the capo is at the desired position along neck 13 lever 23 is pivoted upwardly toward top arm 25 causing the free end of shaft 37 to engage the underside of jaw 22. Continued upward pivoting of lever 23 causes screw 24 to pivot jaw 22 upwardly thus closing it against back 17 of neck 13. FIG. 5 depicts the nature of the engagement between the free end of shaft 37 and jaw 22 that causes the closing of the latter. As the lever link 23 is pivoted upwardly, the free end of the screw link 24 swings through an arc (indicated by a dashed line in FIG. 5), the radius of which may be changed by adjusting screw link 24 upwardly or downwardly. When that arc intersects jaw link 22 the upward pivoting (and closing) of jaw link 22 commences. As the upward pivoting of lever link 23 continues, the free end of screw link 24 slides along a bearing path on the underside of jaw link 22 and forces jaw link 22 closed. As jaw link 22 is closed on neck 13, the latter is forced upward into engagement with pad 32 on the underside of top arm link 25, thereby depressing strings 18 against fingerboard 16. The closing of jaw link 22 is complete when lever 23 engages the underside of jaw 22. The extent to which jaw 22 is closed will depend upon the length of shaft 37 that extends above lever 23. That length may be altered by advancing or withdrawing screw 24. As indicated in FIG. 5 a positive locking action is effected in closing jaw 22 because there is a small zone of interference, indicated by the crosshatched area at 42 in FIG. 5, between jaw link 22 and screw link 24. The links can pass through this zone of interference because frame 19 is slightly resilient due to its geometry and/or the material from which it is made. This resilience allows frame 19 to distort in spring-like fashion, thus causing jaw 22 to have a snap-like action in its final locking motion and initial opening or unlocking motion. In the final locking motion, and jaw goes through a condition of maximum compression when the zone of interference occurs and then is relaxed slightly. Correlatively, in the initial unlocking motion, when lever 23 is pivoted downwardly, jaw 22 moves upwardly as jaw 22 and screw 24 move back through the zone of interference. So, the initial unlocking motion involves compression of the jaw before it is relaxed.

Referring to FIGS. 1 and 3, it can be seen that the free end of lever 23 extends out beyond the free end of jaw 22. The tip portion of lever 23 that extends outwardly of jaw 22 provides a site at which lever 23 may be gripped with the index finger as in FIG. 1 (or thumb if the capo is attached from the other side of the neck) and pivoted downwardly to unlock and release the capo from the neck of the instrument. The unlocking and release procedure, like the closing and locking procedure, involves a fast, easy and continuous action, namely the pivoting of lever 23. As lever 23 is pivoted downwardly, the upward force on jaw 22 is removed permitting it to pivot downwardly and disengage back 17 of neck 13. This, in turn, releases the pressure applied to strings 18 by top arm 25 and pad 32.

Once the capo has been unlocked and released it may be removed from the neck of the instrument or repositioned to another location thereon. In either event, when the capo is again used on the instrument it will automatically exert the same pressure on the strings when lever 23 is pivoted upwardly and the capo is locked in place.

Modifications of the capo shown in the drawings that are obvious to those of skill in the manufacture of stringed instruments and accessories therefor, and in the mechanical arts generally, are intended to be within the scope of the invention. Examples of such modifications are altering the size of the capo to accommodate larger or smaller necks and changing the shapes of jaw 22 and/or top bar 25 to accommodate instruments having neck backs and/or fingerboards of different curvature.

We claim:

1. A capo for use with a stringed instrument having a neck having a fingerboard and a back and a plurality of strings that extend longitudinally over said fingerboard comprising (a) a frame that includes a top arm that extends across the fingerboard above the strings and a side arm that extends generally laterally of the neck;

(b) a jaw member, one end of which is pivotally attached to the side arm, said jaw member extending under said back;

(c) a lever member, one end of which is pivotally attached to the side arm at a point below the site of attachment of the jaw member to the side arm; and (d) an adjusting screw having a threaded shaft that is received through a threaded bore in the lever member and one end of which bears against the underside of the jaw member.

2. The capo of claim 1 wherein the jaw member inclines downwardly relative to the top arm and is curved to facilitate snug engagement with said back.

3. The capo of claim 2 wherein the lever member is planar and its free end extends beyond the free end of the jaw member when the capo is closed about said neck.

4. The capo of claim 1 wherein the adjusting screw has a head for gripping and turning the screw to advance or withdraw the screw within said bore to thereby vary the extent to which the jaw member is closed when the lever member is pivoted toward the jaw member.

5. The capo of claim 4 including:

(e) a helical spring about said shaft between the underside of the lever member and said head for maintaining the position of said screw within said bore.

6. The capo of claim 1 wherein said bore is located between the attached end of the lever member and the midpoint of the lever member.

7. The capo of claim 1 wherein there is a zone of interference between the shaft of the screw and the jaw member whereby a positive locking action of the capo about said neck is effected when the jaw member is closed by pivoting the lever member upwardly.

8. A capo for use with a stringed instrument having a neck having a fingerboard and a back and a plurality of strings that extend longitudinally over said fingerboard comprising:

(a) a frame that includes a top arm that extends across the fingerboard above the strings, a resilient pad on the underside of the top arm, and a side arm that extends generally laterally of the neck;

(b) a jaw member, one end of which is pivotally attached to the side arm, said jaw member extending under said neck and being inclined downwardly relative to the top arm, being curved to facilitate snug engagement with said back, and having a resilient pad on its upper side;

(c) a lever member, one end of which is pivotally attached to the side arm below the jaw member, said lever member being planar and of such length that its free end extends beyond the free end of the jaw member when the capo is closed about the neck;

(d) an adjusting screw having a threaded shaft that is received through a threaded bore in the lever member located between the attached end of the lever member and the midpoint of the lever member, one end of said shaft bearing against the underside of the jaw member and the other end carrying a head by which the screw may be gripped and turned to advance or withdraw the screw within the bore to vary the extent to which the jaw member is closed when the lever member is pivoted toward the jaw member, there being a zone of interference between the shaft and the jaw member whereby a positive locking action of the capo about the neck is effected when the jaw member is closed by pivoting the lever member upwardly; and (e) a helical spring about said shaft between the underside of the lever member and said head for maintaining the position of the screw within the bore.

* * * * *